US006745751B2

(12) United States Patent
Seo et al.

(10) Patent No.: US 6,745,751 B2
(45) Date of Patent: Jun. 8, 2004

(54) HIGH PRESSURE FUEL SUPPLYING APPARATUS FOR INTERNAL COMBUSTION ENGINE AND METHOD FOR CONTROLLING THE APPARATUS

(75) Inventors: Hiromitsu Seo, Toyota (JP); Masanao Idogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/455,529

(22) Filed: Jun. 6, 2003

(65) Prior Publication Data

US 2004/0000289 A1 Jan. 1, 2004

(30) Foreign Application Priority Data

Jun. 28, 2002 (JP) ..... 2002-190258

(51) Int. Cl.[7] ..... F02D 41/06; F02M 37/08
(52) U.S. Cl. ..... 123/456; 123/506; 123/179.17
(58) Field of Search ..... 123/446, 447, 123/456, 458, 497, 506, 179.17

(56) References Cited

U.S. PATENT DOCUMENTS 4,800,861 A * 1/1989 Oshizawa et al. ..... 123/506
5,555,872 A * 9/1996 Takeuchi et al. ..... 123/497
5,842,454 A * 12/1998 Miwa et al. ..... 123/497
6,065,436 A * 5/2000 Koga et al. ..... 123/179.17

FOREIGN PATENT DOCUMENTS

JP 10-61468 A 3/1998

* cited by examiner

*Primary Examiner*—Weilun Lo
(74) *Attorney, Agent, or Firm*—Kenyon & Kenyon

(57) ABSTRACT

A fuel pump draws pumps fuel from a fuel tank to a pressurizing chamber during a suction stroke, and pressurizes and sends fuel in the pressurizing chamber to a delivery pipe. A electromagnetic valve is actuated by electricity from a battery to electively connects and disconnects the fuel tank with the pressurizing chamber. An ECU determines opening and closing timing of the electromagnetic valve based on the rotation al phase of an engine. When the rotational phase of the engine is not identified, the ECU executes a duty control to cyclically repeat supplying and stopping of current to the electromagnetic valve. The ECU extends a current supplying period in each cycle of the duty control as the voltage of the power supply is lowered. As a result, the electromagnetic valve is reliably closed particularly at each pressurizing stroke, which improves the pressure increasing efficiency of fuel supplied to a fuel injection system.

17 Claims, 12 Drawing Sheets

HIGH PRESSURE FUEL SUPPLYING APPARATUS FOR INTERNAL COMBUSTION ENGINE AND METHOD FOR CONTROLLING THE APPARATUS

BACKGROUND OF THE INVENTION

The present invention relates to an high pressure fuel supplying apparatus for in an internal combustion engine, which apparatus sends high pressure fuel to a fuel injection system of the engine, and to a method for controlling the apparatus.

Japanese Laid-Open Patent Publication No. 10-61468 discloses a high pressure fuel pump having a plunger that is reciprocated by rotation of a crankshaft of an engine. Reciprocation of the plunger in a pressurizing chamber draws fuel into the pressurizing chamber and pressurizes the drawn fuel. The pressurized fuel is sent to a delivery pipe.

During a suction stroke of the plunger, in which the pressurizing chamber is expanded, an electromagnetic valve located in the pressurizing chamber is supplied with no current and is thus opened. As a result, fuel is supplied to the interior of the pressurizing chamber from a feed pump, which forms part of a fuel supply source. During a pressurizing stroke of the plunger, in which the pressurizing chamber is compressed, the electromagnetic valve is supplied with current and closed at a time corresponding to the amount of fuel that is to be sent to the fuel injection system. As a result, fuel in the pressurizing chamber is pressurized. The pressurized fuel pushes open a fuel discharge valve and is supplied to the delivery pipe, which forms part of a fuel injection system.

The plunger of the aforementioned publication is reciprocated by rotation of the crankshaft of the internal combustion engine. Therefore, in order to determine the stroke position of the plunger in the pressurizing chamber, the rotational phase angle of the crankshaft must be identified. However, the rotational phase angle of the crankshaft cannot be identified, for example, when the engine is being cranked. At this time, it is impossible to control the electromagnetic valve according to a normal process even if the high pressure pump is operating. Thus, when the engine is being cranked, high pressure fuel is not supplied to the fuel injection system, and fuel in the fuel injection system is not pressurized at an early stage. This hinders a desirable fuel injection and degrades the starting of the engine.

To eliminate this drawback, the technology disclosed in the above publication pressurizes fuel in the fuel injection system at an early stage in the following manner. That is, when the rotation phase angle of the crankshaft is not identified, a duty control is performed to supply and stop current to the electromagnetic valve in short cycles. Each suction stroke of the plunger corresponds to each current stopping period of the duty control. In each current stopping period, the electromagnetic valve is opened, and fuel is drawn into the pressurizing chamber. When the plunger is at a pressurizing stroke, the electromagnetic valve is closed at a first current supplying timing in the duty control. During this closing period of the electromagnetic valve, the pressure of the fuel in the pressurizing chamber increases. Although current to the electromagnetic valve is stopped after the closing period, the pressure of the fuel in the pressurizing chamber maintains the closed state of the electromagnetic valve. In the subsequent pressurizing strokes, the electromagnetic valve is not opened regardless of whether the duty control is performed. Therefore, even if the rotational phase angle of the crankshaft is not identified, the pressure of the fuel in the pressurizing chamber is increased, so that the fuel pushes open the fuel discharging valve and is supplied to the fuel injection system in a pressurized state.

However, when the engine is being cranked, the voltage of a power supply, such as a battery, is lowered due to an electrical load created by activation of a starter motor. If the voltage is significantly lowered, the electromagnetic valve is not completely closed during the current supplying period in the duty control, which results in an insufficient pressure increase in the pressurizing chamber. This possibly hinders the fuel injection system from receiving high pressure fuel, and prevents the pressurizing efficiency of fuel supplied to the fuel injection system from being improved.

SUMMARY OF THE INVENTION

Accordingly, it is an objective of the present invention to provide a high pressure fuel supplying apparatus for an internal combustion engine and a method for controlling the apparatus, which apparatus and method improve the pressurizing efficiency of fuel supplied to a fuel injection system.

To achieve the foregoing and other objectives and in accordance with the purpose of the present invention, a high pressure fuel supplying apparatus is provided. The apparatus pressurizes fuel supplied from a fuel supply source and sends the pressurized fuel to a fuel injection system of an internal combustion engine. The apparatus includes a fuel pump, an electromagnetic valve, a voltage detecting device, and a controller. The fuel pump has a pressurizing chamber, and repeats a pressurizing stroke and a suction stroke in accordance with rotation of the engine. During each suction stroke, the fuel pump draws fuel from the fuel supply source to the pressurizing chamber. During each pressurizing stroke, the fuel pump pressurizes fuel in the pressurizing chamber and sends the pressurized fuel to the fuel injection system. The electromagnetic valve selectively connects and disconnects the pressurizing chamber with the fuel supply source. The electromagnetic valve is actuated by electricity supplied from a power supply. The voltage detecting device detects a voltage of the power supply. The controller controls the electromagnetic valve. To adjust an amount of fuel to be supplied to the fuel injection system, the controller determines opening and closing timing of the electromagnetic valve based on a rotational phase of the engine. When the rotational phase of the engine is not identified, the controller executes a duty control to cyclically repeats supplying and stopping of current to the electromagnetic valve. The controller extends a current supplying period in each cycle of the duty control as the voltage detected by the voltage detecting device is lowered.

In another aspect of the present invention, a method for controlling a high pressure fuel supplying apparatus for an internal combustion engine is provided. The apparatus includes a fuel pump having a pressurizing chamber and an electromagnetic valve. The fuel pump repeats a pressurizing stroke and a suction stroke in accordance with rotation of the engine. During each suction stroke, the fuel pump draws fuel from a fuel supply source to the pressurizing chamber. During each pressurizing stroke, the fuel pump pressurizes fuel in the pressurizing chamber and sends the pressurized fuel to a fuel injection system of the engine. The electromagnetic valve is actuated by electricity supplied from a power supply to selectively connect and disconnect the pressurizing chamber with the fuel supply source. The method includes: determining opening and closing timing of the electromagnetic valve based on a rotational phase of the engine, thereby adjusting an amount of fuel to be supplied to the fuel injection system; executing a duty control to cyclically repeats supplying and stopping of current to the electromagnetic valve when the rotational phase of the engine is not identified; and extending a current supplying period in each cycle of the duty control as the voltage of the power supply is lowered.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 7.

Figure 1:
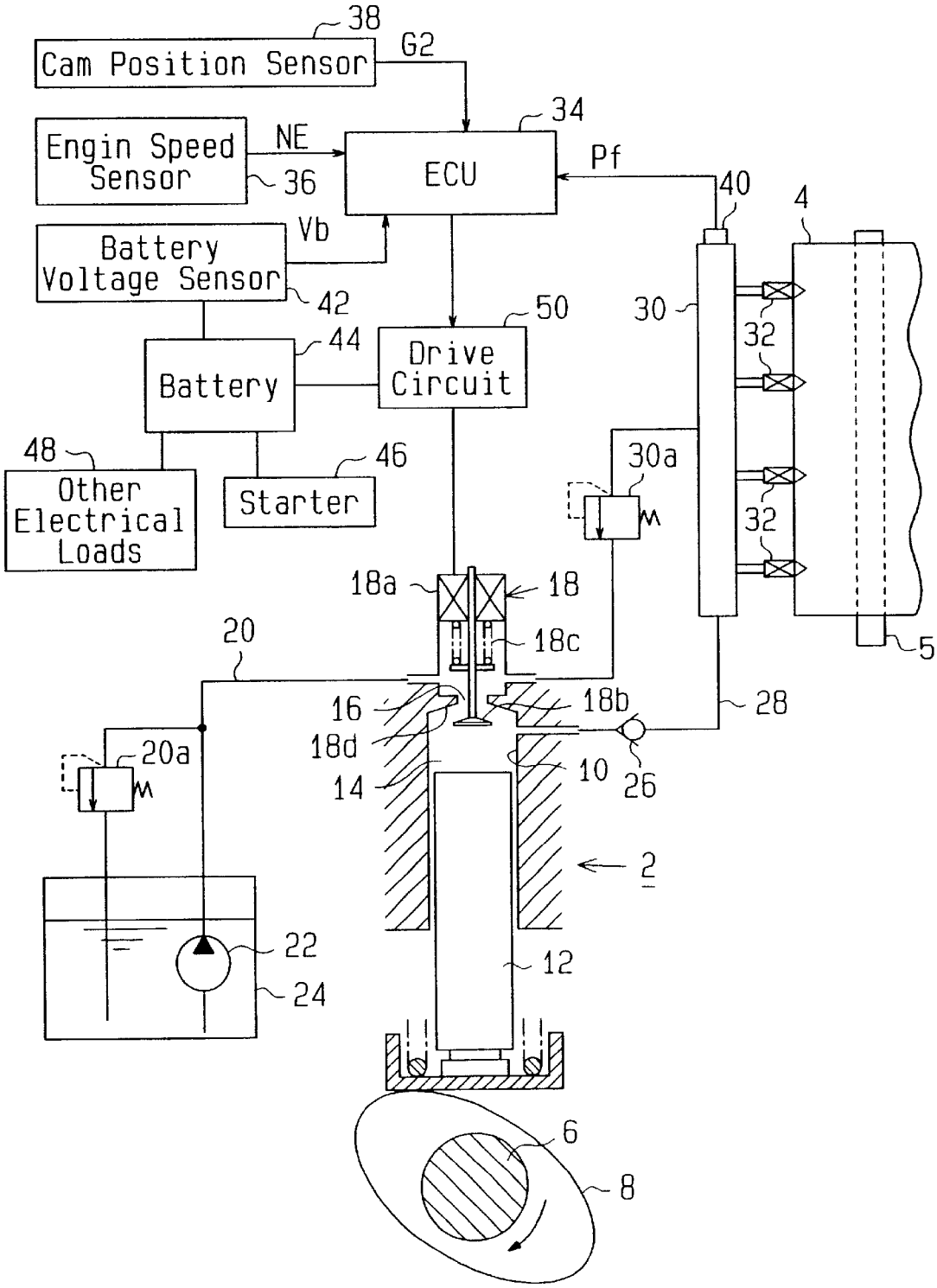
FIG. 1 is a diagrammatic view illustrating a high pressure fuel pump, an engine, and a control system according to a first embodiment.

FIG. 1 shows a high pressure fuel pump 2, an internal combustion engine, and a control system for controlling the pump 2 and the engine. In this embodiment, the internal combustion engine is a cylinder injection type gasoline engine 4.

The engine 4 has engine cylinders (not shown), fuel injection valves 32, a crankshaft 5. A combustion chamber is defined in each engine cylinder, and each fuel injection valve 32 corresponds to one of the engine cylinders. A delivery pipe 30 is connected to the fuel injection valves 32. The fuel injection valves 32 and the delivery pipe 30 form a fuel injection system. A piston (not shown) reciprocates in each engine cylinder. Accordingly, the crankshaft 5 rotates.

The high pressure fuel pump 2 includes a camshaft 6 interlocked with the crankshaft 5, a cam 8 located on the camshaft 6, a cylinder 10, and a plunger 12. The plunger 12 is reciprocated by the cam 8. The cylinder 10 and the plunger 12 define a pressurizing chamber 14. The high pressure fuel pump 2 further includes an electromagnetic valve 18. The electromagnetic valve 18 is arranged to correspond to a fuel inlet 16 that opens to the pressurizing chamber 14.

Fuel is pumped out of a fuel tank 24 by a feed pump 22. The fuel tank 24 and the feed pump 22 form a fuel supply source. Fuel is then drawn in to the pressurizing chamber 14 through a low pressure fuel passage 20 and the fuel inlet 16 during a suction stroke of the high pressure fuel pump 2, or during a suction stroke of the plunger 12. Some of the fuel that is pumped out by the feed pump 22 is not sent to the high pressure fuel pump 2. Such fuel or fuel that is returned to the low pressure fuel passage 20 from the high pressure fuel pump 2 are returned to the fuel tank 24 through a relief valve 20*a*.

During a pressurizing stroke of the high pressure fuel pump 2, or during a pressurizing stroke of the plunger 12, high pressure fuel that is pressurized in the pressurizing chamber 14 pushes open a check valve 26 and is sent to the delivery pipe 30 through a high pressure fuel passage 28. As a result, high pressure fuel is pressurized to a level that enables the fuel to be injected into the combustion chambers of the engine cylinders at a compression stroke. The fuel is then supplied to each fuel injection valve 32. If there is surplus fuel that is not subjected to injection in the delivery pipe 30, the surplus fuel is returned to a low pressure fuel passage 20 through the relief valve 30*a*.

An electronic control unit (ECU) 34 controls the electromagnetic valve 18 to adjust the amount of high pressure fuel supplied from the high pressure fuel pump 2 to the delivery pipe 30. The ECU 34 is a controller that has an electronic circuit including a digital computer. The ECU 34 receives detection signals from an engine speed sensor 36, a cam position sensor 38, a fuel pressure sensor 40, a battery voltage sensor 42, and other sensors and switches. The engine speed sensor 36 is provided at the crankshaft 5, and outputs a pulse signal NE every time the crankshaft 5 rotates by 30°. The rotational phase angle of the crankshaft 5 (the rotational phase of the engine 4) is referred to as a crank angle. A range of the crank angle from a predetermined reference angle, or 0°, to 720° is referred to one cycle. That is, a rotational angle corresponding to two turns of the crankshaft 5 is referred to as one cycle. The cam position sensor 38 is provided at the camshaft 6, which rotates one turn while the crankshaft 5 rotates two turns. The cam position sensor 38 outputs a reference crank angle signal G2 at a timing when the crank angle is the reference crank angle (the reference rotational phase of the engine 4). The engine speed sensor 36 and the cam position sensor 38 function as a device for detecting the rotational phase of the engine 4. The fuel pressure sensor 40 is provided at the delivery pipe 30 and outputs a signal that represents the fuel pressure in the delivery pipe 30, or a pressure Pf of fuel supplied to the fuel injection valves 32. The battery voltage sensor 42, which functions as a voltage detecting device, detects a voltage Vb of a battery 44 and outputs a signal corresponding to the voltage Vb. The battery 44 is a power supply of the electromagnetic valve 18, an engine starter 46, and other electrical loads 48.

The ECU 34 performs computations based on inputted signals to control a drive circuit 50, thereby supplying and stopping a current from the battery 44 to the electromagnetic valve 18. The ECU 34 also performs other engine controls including a fuel injection control and an ignition timing control.

The ECU 34 identifies a reference crank angle based on the reference crank angle signal G2 from the cam position sensor 38. Using the reference crank angle as a starting point, the ECU 34 identifies the current crank angle based on the pulse signal NE from the engine speed sensor 36. Therefore, while the engine 4 is being cranked, the ECU 34 cannot identify the crank angle until receiving the first reference crank angle signal G2.

The electromagnetic valve 18 includes an excitation coil 18*a*, a valve body 18*b*, and a spring 18*c*. The valve body 18*b* is located in the pressurizing chamber 14 and driven by the excitation coil 18*a*. The spring 18*c*, which functions as an urging member, urges the valve body 18*b* away from a valve seat 18*d* provided about the fuel inlet 16. The valve seat 18*d* is located in an inner wall of the pressurizing chamber 14 that faces the valve body 18*b*. When the excitation coil 18*a* is supplied with current, the valve body 18*b* is moved towards the valve seat 18*d* against the force of the spring 18*c*, and contacts the valve seat 18*d*. As a result, the fuel inlet 16 is closed by the valve body 18*b*, and the pressurizing chamber 14 is disconnected from the fuel inlet 16. When current to the excitation coil 18*a* is stopped, the valve body 18*b* is moved away from the valve seat 18*d* by the force of the spring 18*c*, and opens the fuel inlet 16. Accordingly, the pressurizing chamber 14 is connected with the fuel inlet 16. The electromagnetic valve 18 is configured as an internally opening valve that is opened when the valve body 18*b* in the pressurizing chamber 14 moves towards the interior of the pressurizing chamber 14.

Figure 2A:
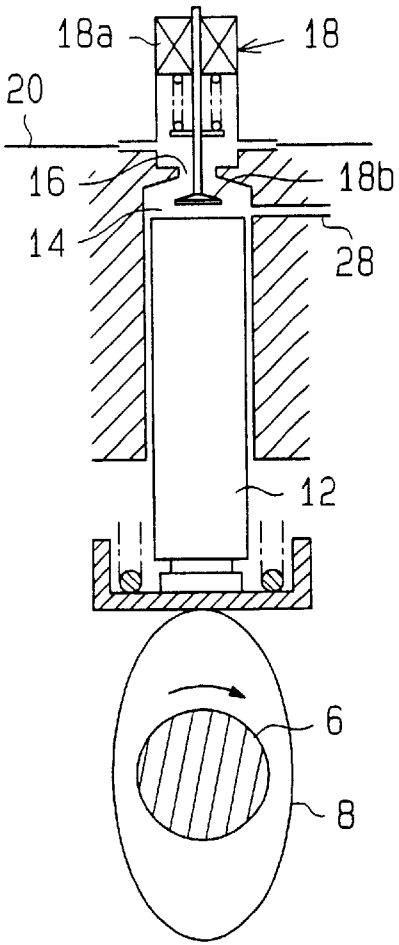
FIGS. 2(A) to 2(C) are cross-sectional views showing a suction stroke of the high pressure fuel pump of FIG. 1 after the crank angle is identified.
Figure 2B:
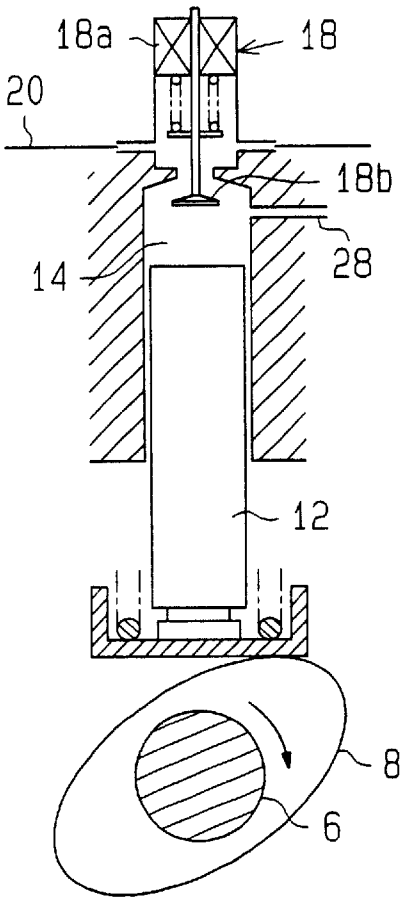
Figure 2C:
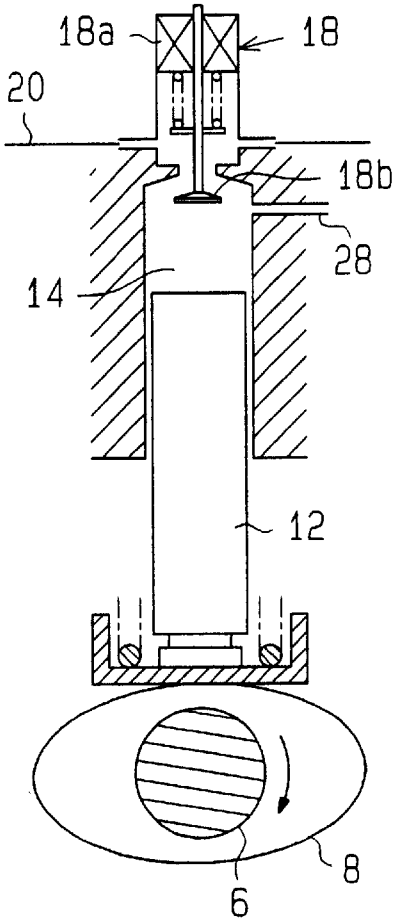
Figure 3A:
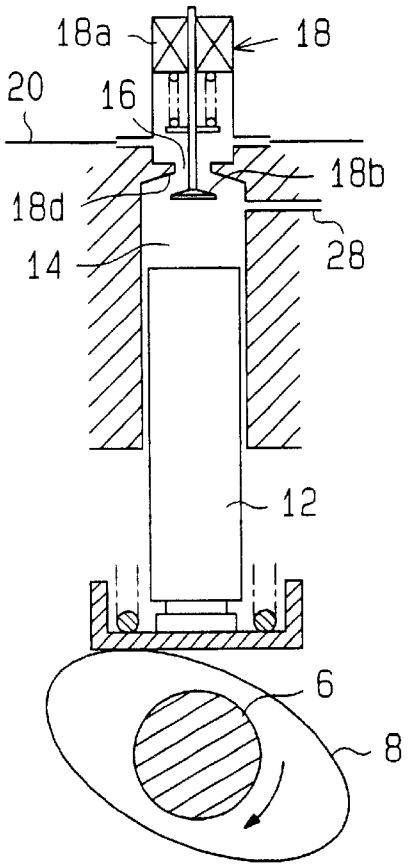
FIGS. 3(A) to 3(C) are cross-sectional views showing a pressurizing stroke of the high pressure fuel pump of FIG. 1 after the crank angle is identified.
Figure 3B:
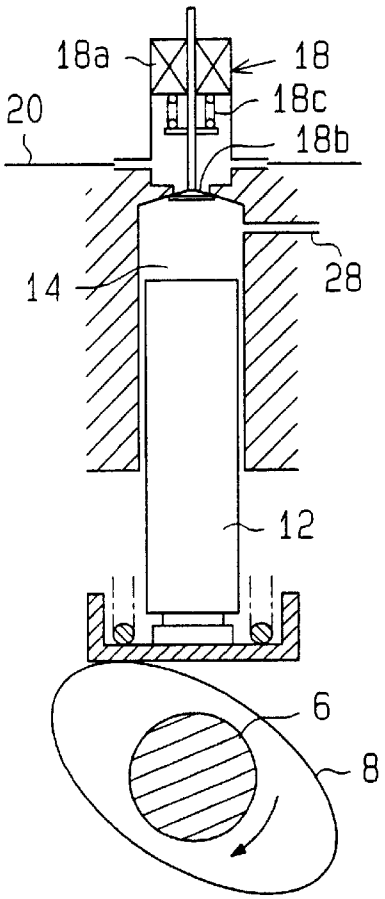
Figure 3C:
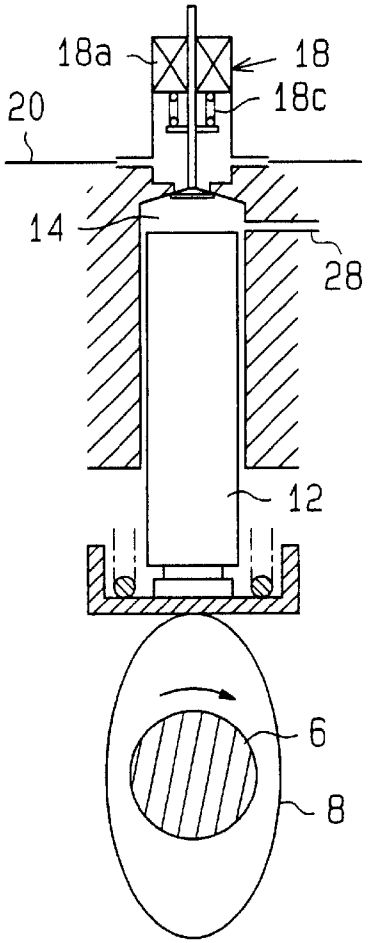

A process for controlling current to the electromagnetic valve 18 when the crank angle is identified will now be described with reference to FIGS. 2(A) to 3(C). The process is executed by the ECU 34. FIGS. 2(A) to 2(C) show a suction stroke of the high pressure fuel pump 2, and FIGS. 3(A) to (C) show a pressurizing stroke of the high pressure fuel pump 2. In a suction stroke, the excitation coil 18*a* of the electromagnetic valve 18 is supplied with no current, and the electromagnetic valve 18 is opened. In this case, as the plunger 12 moves along the states of FIG. 2(A), FIG. 2(B), and FIG. 2(C) in this order, the volume of the pressurizing chamber 14 is increased. That is, the pressurizing chamber 14 is expanded. Accordingly, low-pressure fuel is drawn into the pressurizing chamber 14 from the low pressure fuel passage 20 through the fuel inlet 16.

When the high pressure fuel pump 2 proceeds from a suction stroke to a pressurizing stroke, the plunger 12 moves along the states of FIG. 3(A), FIG. 3(B), FIG. 3(C) in this order. Accordingly, the volume of the pressurizing chamber 14 is decreased. That is, the pressurizing chamber 14 is compressed. As shown in FIG. 3(A) the excitation coil 18*a* is not supplied with current at initial stages of a pressurizing stroke. The electromagnetic valve 18 is therefore open. Thus, some of the fuel in the pressurizing chamber 14 is returned to the low pressure fuel passage 20 from the fuel inlet 16, and the pressure of the fuel in the pressurizing chamber 14 is not increased and maintained low. Thereafter, the excitation coil 18*a* is supplied with current at a timing computed by the ECU 34. Then, as shown in FIG. 3(B), the valve body 18*b* contacts the valve seat 18*d* against the force of the spring 18*c* during a pressurizing stroke. As a result, the fuel inlet 16 is closed, and the pressure of the fuel in the pressurizing chamber 14 is increased. The pressurized fuel pushes open the check valve 26 shown in FIG. 1 and is sent to the delivery pipe 30 through the high pressure fuel passage 28.

After the pressure in the pressurizing chamber 14 is increased, the increased pressure is maintained until the next suction stroke is started. Therefore, even after current to the excitation coil 18*a* is stopped, the valve body 18*b* continues contacting the valve seat 18*d* against the force of the spring 18*c* due to the difference between the high pressure in the pressurizing chamber 14 and the low pressure in the low pressure chamber 20. When the high pressure fuel pump 2 proceeds from a pressurizing stroke to a suction stroke, the pressure in the pressurizing chamber 14 is lowered as the volume of he pressurizing chamber 14 is increased. Accordingly, the valve body 18*b* is moved away from the valve seat 18*d* by the force of the spring 18*c*, which opens the electromagnetic valve 18.

While the camshaft 6 rotates one turn, in other words, while the crankshaft 5 rotates two turns, the plunger 12 reciprocates two times. Accordingly, the pump cycle including a suction stroke and a pressurizing stroke is repeated two times.

Figure 4:
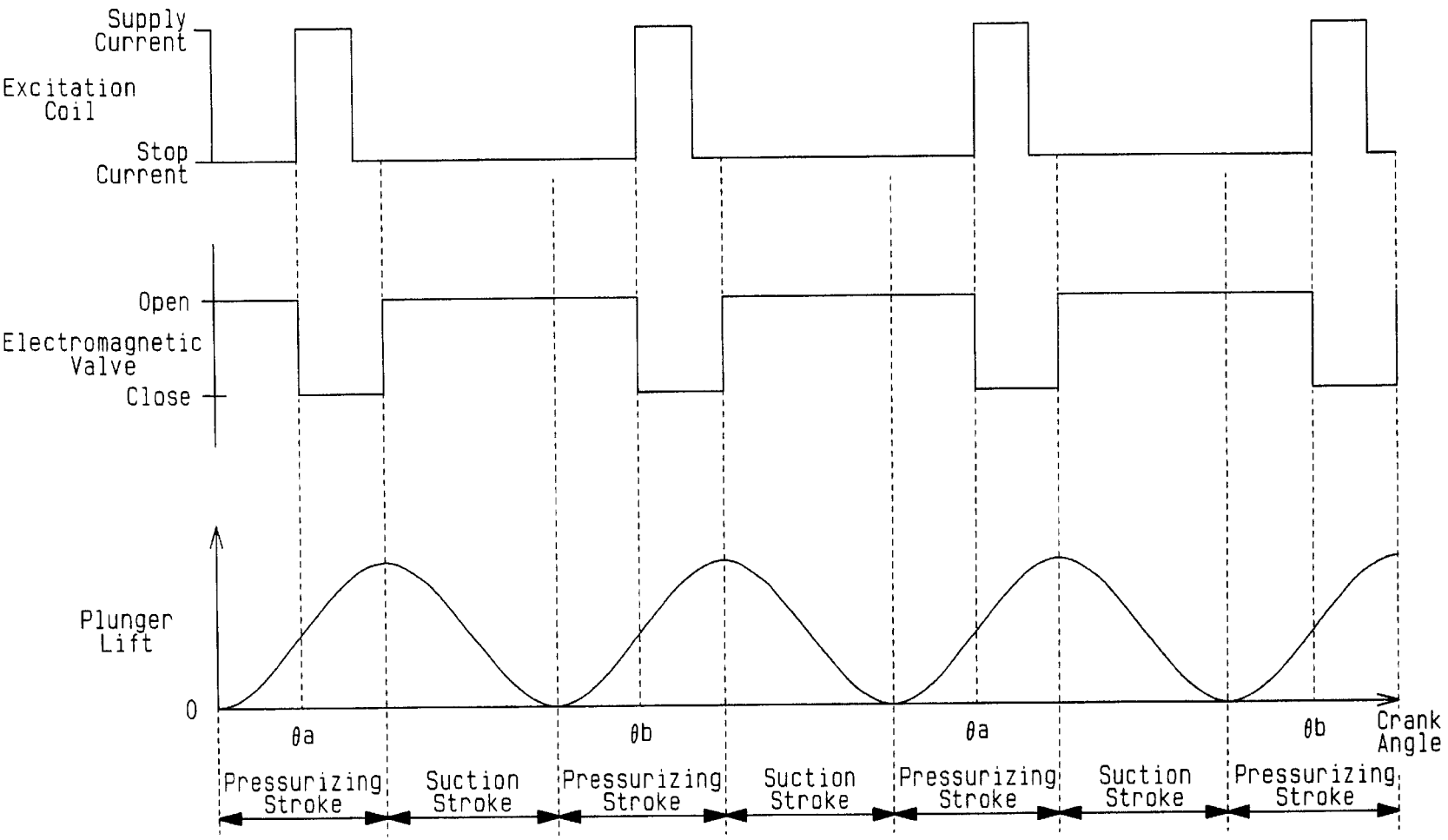
FIG. 4 is a crank angle chart showing an operation of the high pressure pump of FIG. 1 after the crank angle is identified.

When the crank angle is identified, the ECU 34 is capable of identifying the rotational phase angle of the cam 8, which rotates synchronously with the crankshaft 5, based on the crank angle, that is, the ECU 34 is capable of identifying the stroke position of the high pressure pump 2 (the plunger 12). Therefore, when the crank angle is identified, the ECU 34 is capable of determining timing for switching strokes of the high pressure pump 2 and of setting timing for starting current supply to the excitation coil 18*a* in relation to the stroke switching timing. For example, while the camshaft 6 rotates one turn (corresponding to two turns of the crankshaft 5) as shown in FIG. 4, the ECU 34 is capable of setting the timing for starting current supply to the excitation coil 18*a* to correspond to desired crank angles θa, θb. As a result, the amount of high-fuel pressure fuel supplied to the fuel injection system including the delivery pipe 30 and the fuel injection valve 32 is adjusted, so that the fuel pressure Pf in the fuel injection system is adjusted to a target value. If the current supply starting crank angles θa, θb in a pressurizing stroke are advanced, the amount of high pressure fuel sent to the fuel injection system is increased, and the fuel pressure Pf is increased. If the current supply starting crank angles θa, θb are delayed, the amount of high pressure fuel sent to the fuel injection system is decreased, and the fuel pressure Pf is lowered.

As described above, the crank angle cannot be identified when the engine 4 is being cranked until a first reference crank angle signal G2 is generated. Therefore, the stroke position of the plunger 12, which is interlinked with the crankshaft 5, cannot be identified, and the current control as shown in FIG. 4 cannot be performed. Thus, when the crank angle cannot be identified, or when the engine 4 is being cranked, the ECU 34 performs a duty control process shown in FIG. 5 to control a current to the electromagnetic valve 18, thereby sending pressurized fuel to the fuel injection system.

Figure 5:
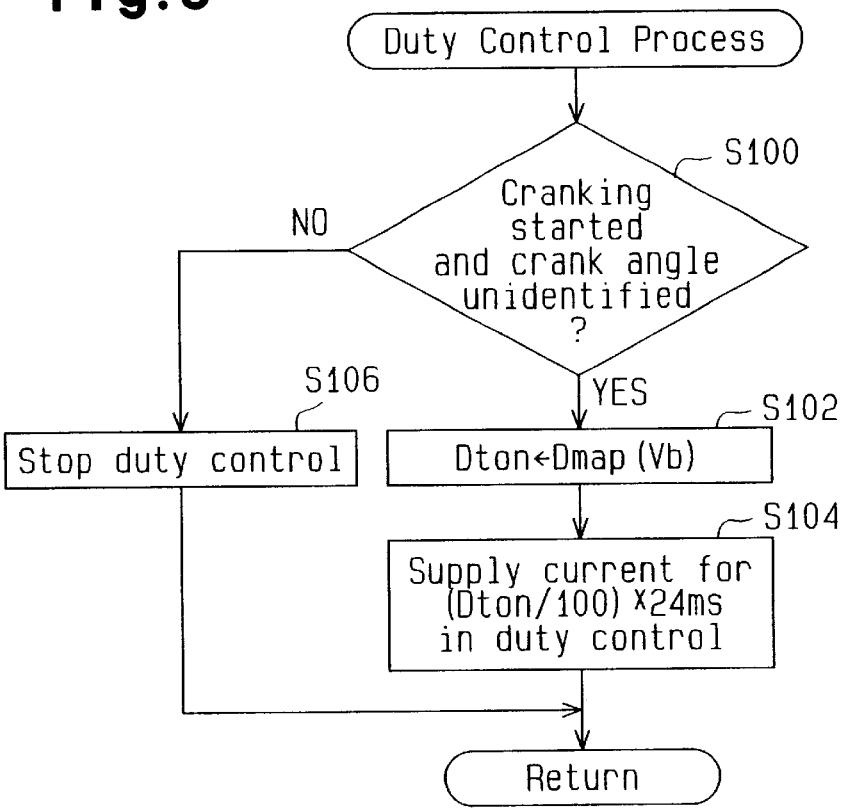
FIG. 5 is a flowchart showing a duty control process executed when the engine is being cranked.

The duty control process will now be described with reference to FIG. 5. The process of FIG. 5 is repeatedly executed at a given interval, for example 24 ms, after the ECU 34 is turned on. When the process is started, the ECU 34 executes step S100. In step S100, the ECU 34 determines whether cranking of the engine 4 has been started (whether the starter 46 has been actuated) and the crank angle is yet to he identified. That is, the ECU 34 determines whether the crank angle is yet to be identified. If the crank angle is yet to be identified, the ECU 34 proceeds to step S102. In step S102, the ECU 34 uses a duty map Dmap shown in FIG. 6 for computing a duty ratio Dton that corresponds to a current battery voltage Vb.

The duty ratio Dton represents a ratio of time in which current is supplied to the excitation coil 18*a* (current supplying period) to the execution cycle of the duty control, which is 24 ms. In the map Dmap shown in FIG. 6, the duty ratio Dton increases as the battery voltage Vb is lowered.

Figure 6:
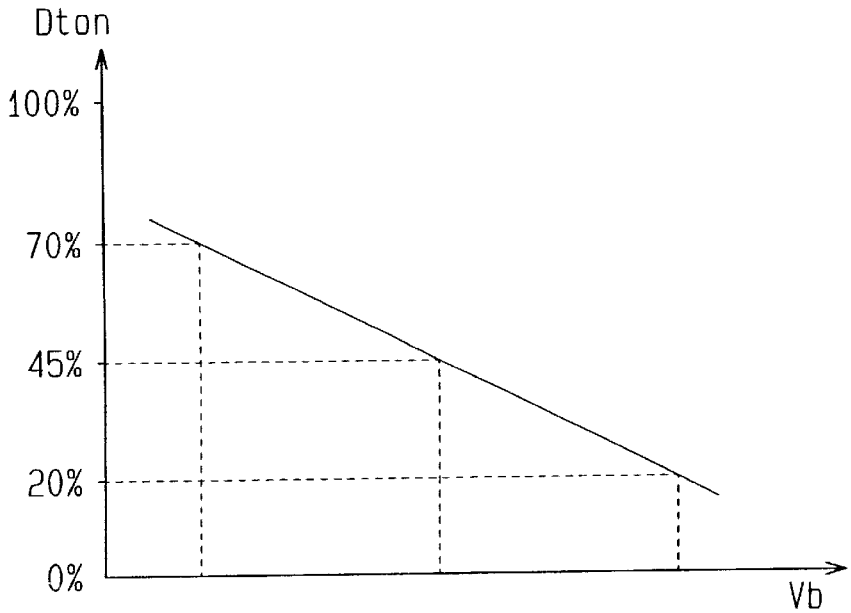
FIG. 6 is a graph showing a duty map Dmap used in the duty control process of FIG. 5.

If the battery voltage Vb is lowered when the engine 4 is being cranked, time from when supply of current to the excitation coil 18*a* is started to when the electromagnetic force generated by the excitation coil 18*a* is sufficiently increased is extended. Then, the valve body 18*b* cannot contact the valve seat 18*d* in each current supplying period in the duty control, which may result in an insufficient closing of the electromagnetic valve 18. That is, if the magnitude of the electromagnetic force generated at the excitation coil 18*a* is slowly increased, current is stopped before the valve body 18*b* reaches the valve seat 18*d* even if current supply to the excitation coil 18*a* is started. Thus, to completely close the electromagnetic valve 18 in at least part of each current supplying period of the excitation coil 18*a* even if the battery voltage Vb is low, the duty map Dmap shown in FIG. 6 is defined based on experiments, so that the ratio of the current supplying period is increased as the battery voltage Vb is lowered.

In step S104 of FIG. 5, the ECU 34 controls the drive circuit 50 such that the drive circuit 50 executes a duty control according to the duty ratio Dton computed in the above described manner. That is, the ECU 34 commands the drive circuit 50 to supply current to the excitation coil 18*a* in a period computed by a formula (Dton/100)×24 ms from the present moment, and to stop current to the excitation coil 18*a* after the computed period. Then, the ECU 34 temporarily suspends the process.

Thereafter, as long as the crank angle is unidentified (the positive outcome in step S100), the ECU 34 sets the duty ratio Dton according to the battery voltage Vb and continues duty controlling the excitation coil 18*a*.

If the crank angle is identified (negative outcome in step S100), the ECU 34 proceeds to S106. In step S106, the ECU 34 stops duty control and temporarily suspends the process. Then, as shown in FIG. 4, a normal current control according to the crank angle is started.

Figure 7:
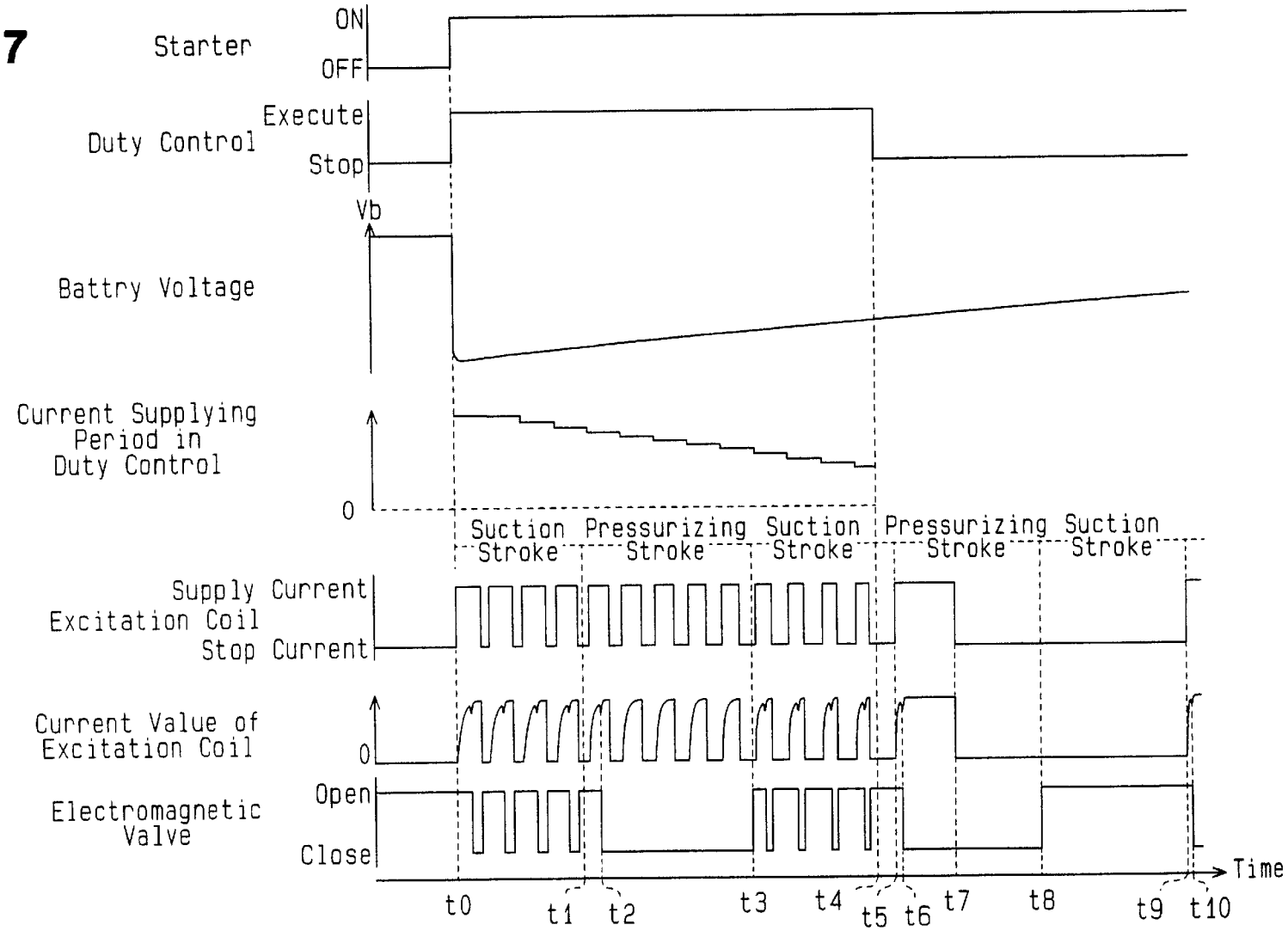
FIG. 7 is a timing chart showing an example of a control of the high pressure fuel pump shown in FIG. 1.

One example of the process according to this embodiment is shown in the timing chart of FIG. 7. When the starter 46 is actuated at time t0, that is, when cranking of the engine 4 is started, the duty control process of FIG. 5 is executed since the crank angle is first unidentified. Accordingly, current is supplied and stopped to the excitation coil 18*a* at short cycles. At this time, each current supplying period is extended according to the duty map Dmap as the battery voltage Vb is lowered so that the electromagnetic valve 18 is completely closed in at least part of each current supplying period of the excitation coil 18*a*.

In the example of FIG. 7, the high pressure fuel pump 2 is in a suction stroke from time t0 to time t1. In the duty control during the suction stroke, the electromagnetic valve 18 is closed in the latter half of the current supplying period of the excitation coil 18*a*. That is, the electromagnetic valve 18 is closed at a little delay after the current supply to the excitation coil 18*a* is started. When no current is supplied to the excitation coil 18*a*, or during a current stopping period, the electromagnetic valve 18 is opened. When the electromagnetic valve 18 is opened, low pressure fuel is drawn into the pressurizing chamber 14 from the low pressure fuel passage 20 through the fuel inlet 16.

From time t1 to time t3, the high pressure fuel pump 2 is in a pressurizing stroke. In the duty control during the pressurizing stroke, the valve body 18*b* contacts the valve seat 18*d* and the electromagnetic valve 18 is closed at time t2, which is a little later from when current supply to the excitation coil 18*a* is started. Accordingly, the pressure in the pressurizing chamber 14 is increased as the plunger 12 is moved. The increased pressure prevents the valve body 18*b* from separating the valve seat 18*d* even if the current to the excitation coil 18*a* is stopped afterwards. Thus, from time t2 to time t3, which is when the pressurizing stroke ends, the electromagnetic valve 18 is kept closed regardless how many times the current to the excitation coil 18*a* is stopped. In the period from time t2 to time t3, high pressure fuel in the pressurizing chamber 14 pushes open the check valve 26 and is sent to the delivery pipe 30.

When the high pressure pump 2 proceeds to a suction stroke (from time t3 to time t5), the electromagnetic valve 18, which is being duty controlled, repeatedly opens and closes according to stopping and supplying of current as in the previous suction stroke (from time t0 to time t1). In the example of FIG. 7, the crank angle is identified at time t4, which is in this suction stroke. Therefore, after time t4, control is shifted from the duty control to the normal control of the electromagnetic valve 18, which is described referring to FIG. 4. That is, since time t4, at which the crank angle is identified, is in a suction stroke, no current is supplied to the excitation coil 18*a* from time t4 to time t5, which is the end of the suction stroke, to keep the electromagnetic valve 18 open.

Although a pressurizing stroke starts at time t5, the cranking of the engine 4 is not yet completed at time t5, and the fuel pressure Pf is not sufficiently increased. Therefore, current is supplied to the excitation coil 18*a* at time t5 to increase the fuel pressure Pf. As a result, the electromagnetic valve 18 is closed at time t6, which is slightly later than time t5. As described above, the pressure in the pressurizing chamber 14 is increased once the electromagnetic valve 18 is closed in a pressurizing stroke, and the electromagnetic valve 18 is kept closed until the end of the pressurizing stroke even if the current to the excitation coil 18*a* is stopped. Therefore, current to the excitation coil 18*a* is stopped at time t7, which is in the pressurizing stroke. From time t6 to time t8, which is the end of the pressurizing stroke, the electromagnetic valve 18 is kept closed. During this period, high pressure fuel is supplied to the delivery pipe 30 from the pressurizing chamber 14.

When a suction stroke is started at time t8, the pressure in the pressurizing chamber 14 is lowered, which causes the electromagnetic valve 18 to be opened by the force of the spring 18*c*. Afterwards, the normal process, in which the electromagnetic valve 18 is opened in a suction stroke and is closed in a pressurizing stroke, is repeated so that the fuel pressure Pf in the fuel injection system is increased to a target fuel pressure.

In the prior art, each current supplying period in a duty control is not extended even if the battery voltage Vg is low. Therefore, even if supplying and stopping of current to the excitation coil 18*a* are repeated in the initial pressurizing stroke (refer to the period from time t1 to time t3 in FIG. 7), the valve body 18*b* cannot contact the valve seat 18*d* in each current supplying period. In other words, the electromagnetic valve 18 cannot be completely closed. Thus, in the initial pressurizing stroke, the pressure of the fuel in the pressurizing chamber 14 is not increased, and fuel is not supplied to the delivery pipe 30. Therefore, high pressure fuel is not supplied to the delivery pipe 30 at least until the next pressurizing stroke. As a result, compared to this embodiment, the pressure of the fuel injection system is increased with a delay, at least, of 0.3 to 0.5 seconds.

This embodiment provides the following advantages.

When the crank angle is yet to be identified while the engine 4 is being cranked, the amount of supplied fuel cannot be adjusted according to the crank angle unlike the case show in FIG. 4. Therefore, in this embodiment, the electromagnetic valve 18 is controlled according to the duty control process shown in FIG. 5 In the duty control process, the duty ratio Dton is increased as the battery voltage Vg is lowered according to the duty map Dmap, thereby extending each current supplying period. Accordingly, as shown in the timing chart of FIG. 7, closing of the electromagnetic valve 18 in each current supplying period, particularly closing of the electromagnetic valve 18 in a pressurizing stroke as shown at time t2, is reliably performed. As a result, even if the battery voltage Vb is low when the crank angle is unidentified, the pressure of fuel supplied to the fuel injection system is effectively increased compared to the prior art.

Therefore, when the engine 4 is being cranked, the pressure of fuel in the fuel injection system is increased to a target value at an early stage, which allows fuel to be reliably injected. This permits the engine 4 to be smoothly started.

Even if the crank angle is not identified, each current supplying period is gradually shortened (or maintained short) if the battery voltage Vb is gradually increased (or if the battery voltage Vb is high from the beginning). Therefore, load on the electrical circuit including the drive circuit 50 and the excitation coil 18*a* is prevented from increasing.

A second embodiment of the present invention will now be described with reference to FIGS. 8 and 9. The differences from the first embodiment of FIGS. 1 to 7 will mainly be discussed.

Figure 8:
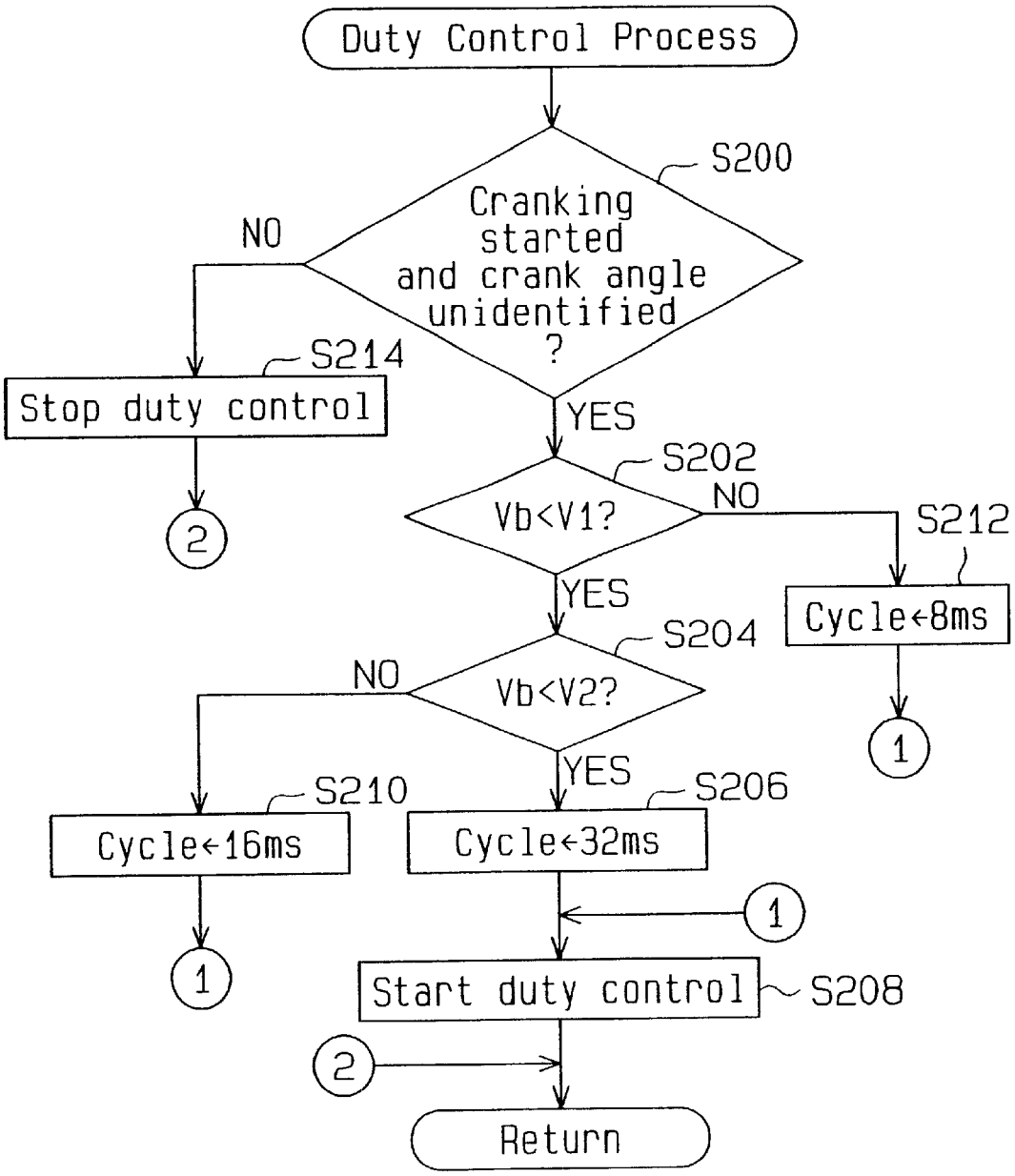
FIG. 8 is a flowchart showing a duty control process according to a second embodiment of the present invention, which process is executed when the engine is being cranked.

This embodiment is different from the first embodiment in that, when the engine 4 is being cranked, a duty control process of FIG. 8 is performed instead of the duty control process of FIG. 5. Like the duty control process of the first embodiment, the duty control process of this embodiment is performed to control the excitation coil 18*a* of the electromagnetic valve 18 before the crank angle is identified. However, in this embodiment, the duty ratio is not varied according to the battery voltage Vb but is fixed to a given value (for example, 50%). Instead, the cycle of the duty control is varied according to the battery voltage Vb.

The duty control process of this embodiment will now be described with reference to a flowchart of FIG. 8. The process is repeatedly executed at a given interval, for example 8 ms, after the ECU 34 is turned on. When the process is started, the ECU 34 determines whether cranking of the engine 4 has been started and the crank angle is yet to be identified in step S200. If the crank angle is yet to be identified, the ECU 34 proceeds to step S202, and determines whether the battery voltage Vb is less than a predetermined first determination value V1. If the battery voltage Vb is less than the first determination value V1, the ECU 34 proceeds to step S204, and determines whether the battery voltage Vb is less than a predetermined second determination value V2. The second determination value V2 is less than the first determination value V1.

If the battery voltage Vb is less than the second determination value V2, the ECU 34 proceeds to step S206, and sets the cycle of the duty control to 32 ms. In step S208, the ECU 34 controls the drive circuit 50 to perform the duty control of the set cycle of 32 ms. Then, the ECU 34 temporarily suspends the process.

Therefore, if the battery voltage Vb is less than the second determination value V2, the duty control at a cycle of 32 ms is performed with a constant duty ratio to the excitation coil 18*a* of the electromagnetic valve 18. Thus, when the duty ratio is set to 50%, each current supplying period is 16 ms in the duty control.

Thereafter, when the battery voltage Vb is raised to be equal to or higher than the second determination value V2 and less than the first determination value V1, the outcome of step S204 is negative. In this case, the ECU 34 proceeds to step S210. In step S210, the ECU 34 sets the cycle of the duty control to 16 ms and proceeds to step S208. Therefore, if the battery voltage Vb is equal to or higher than the second determination value V2 and less than the first determination value V1, a duty control at a cycle of 16 ms is performed with a constant duty ratio (50%) to the excitation coil 18*a* of the electromagnetic valve 18. Each current supplying period of the duty control is 8 ms.

Thereafter, when the battery voltage Vb is increased to a value equal to or greater than the first determination value V1, the outcome of step S202 is negative. In this case, the ECU 34 proceeds to step S212. In step S212, the ECU 34 sets the cycle of the duty control to 8 ms and proceeds to step S208. Therefore, if the battery voltage Vb is equal to or higher than the first determination value V1, a duty control at a cycle of 8 ms is performed with a constant duty ratio (50%) to the excitation coil 18*a* of the electromagnetic valve 18. Each current supplying period of the duty control is 4 ms.

As long as the crank angle is unidentified (the positive outcome in step S200), the ECU 34 sets the cycle of the duty ratio according to the battery voltage Vb and continues duty controlling the excitation coil 18*a*.

If the crank angle is identified (negative outcome in step S200), the ECU 34 proceeds to S214. In step S214, the ECU 34 stops the duty control and temporarily suspends the process. Afterwards, as long as the crank angle is identified, a normal current control according to the crank angle is executed (see FIG. 4).

Figure 9:
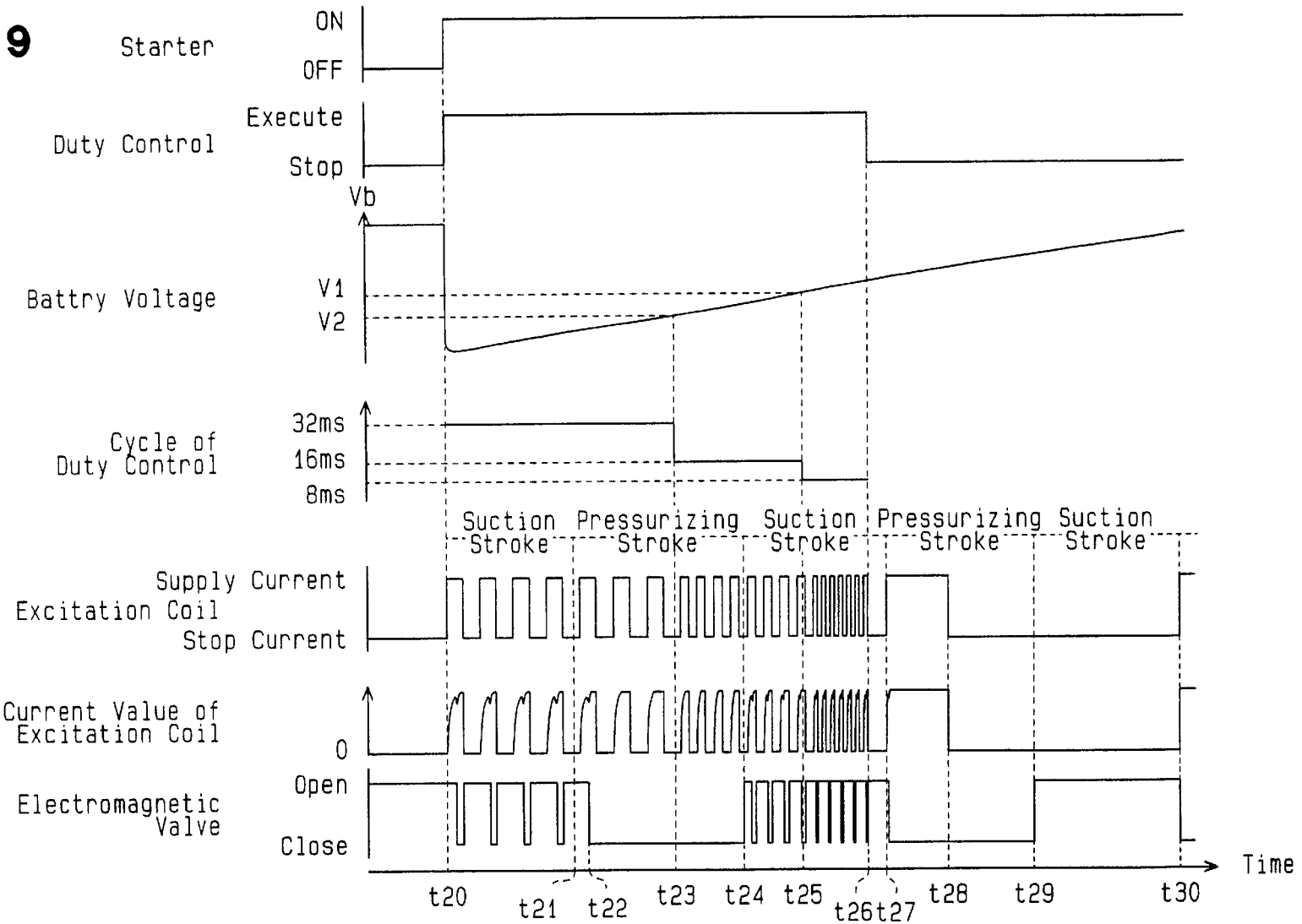
FIG. 9 is a timing chart showing an example of a control of a high pressure fuel pump according to the second embodiment.

One example of the process according to this embodiment is shown in the timing chart of FIG. 9. When the starter 46 is actuated at time t20, the duty control process of FIG. 8 is executed until time t26, at which the crank angle is identified. Accordingly, current is supplied and stopped to the excitation coil 18*a* at short cycles. In the period from t20, to time t23, in which the battery voltage Vb is less than the second determination value V2, the cycle of the duty control is set to 32 ms. In the period from t23 to time t25, in which the battery voltage Vb is equal to or higher than the second determination value V2 and less than the first determination value V1, the cycle of the duty control is set to 16 ms. In the period from t25, at which the battery voltage Vb is equal to or higher than the first determination value V1, to time t26, the cycle of the duty control is set to 8 ms.

During the above described duty control, the electromagnetic valve 18 is repeatedly closed and opened in accordance with supplying and stopping of current in the period of each suction stroke of the high pressure pump 2 (the period from time t20 to time t21, and the period from t24 to t26). When the electromagnetic valve 18 is opened, low pressure fuel is drawn into the pressurizing chamber 14 from the low pressure fuel passage 20 through the fuel inlet 16.

In a pressurizing stroke from time t21 to time t24, the electromagnetic valve 18 is closed at t22. Afterwards, the electromagnetic valve 18 is kept closed due to an increased pressure of the pressurizing chamber 14 until time t24, which is the end of the pressurizing stroke, regardless how many times current to the excitation coil 18*a* is stopped. In the period from time t22 to time t24, in which the electromagnetic valve 18 is closed, high pressure fuel in the pressurizing chamber 14 pushes open the check valve 26 and is sent to the delivery pipe 30.

In a suction stroke from time t24 to time t27, the crank angle is identified at t26. Therefore, after time t26, the control is shifted from the duty control to the normal control for the electromagnetic control described referring to FIG. 4. That is, the normal process, in which the electromagnetic valve 18 is opened in a suction stroke and is closed in a pressurizing stroke, is repeated so that the fuel pressure Pf is increased to a target fuel pressure.

In the prior art, the cycle of the duty control is not extended even if the battery voltage Vg is low, and each current supplying period of the duty control is not extended. Therefore, in the initial pressurizing stroke (refer to the period from time t21 to t24 in FIG. 9), the pressure of the fuel in the pressurizing chamber 14 is not increased, and the fuel is not supplied to the delivery pipe 30. Therefore, compared to this embodiment, the pressure increase in the fuel injection system is delayed.

This embodiment provides the following advantages.

In the duty control of this embodiment, the cycle of the duty control is extended as the battery voltage Vb is lowered, thereby extending each current supplying period. Accordingly, as shown in the timing chart of FIG. 9, closing of the electromagnetic valve 18 in each current supplying period, particularly as shown at time t22, closing of the electromagnetic valve 18 in a pressurizing stroke, is reliably performed. As a result, even if the battery voltage Vb is low when the crank angle is unidentified, the pressure of fuel supplied to the fuel injection system is effectively increased compared to the prior art.

Therefore, when the engine 4 is being cranked, the pressure of fuel in the fuel injection system is increased to a target value at an early stage, which allows fuel to be reliably injected. This permits the engine 4 to be smoothly started.

Even if the crank angle is not identified, the cycle of the duty control is gradually shortened (or maintained short) if the battery voltage Vb is gradually increased (or if the battery voltage Vb is high from the beginning). Therefore, each current supplying period in the duty control is not unnecessarily extended, and thus load on the electrical circuit including the drive circuit 50 and the excitation coil 18*a* is prevented from unnecessarily increasing.

When the battery voltage Vb is low, each current supplying period is extended not only by increasing the ratio of the current supplying period to one cycle of the duty control but by extending the cycle of the duty control. Therefore, the duty ratio does not need to be changed. This effectively prevents the load on the electrical circuit from increasing.

Further, the cycle of the duty control is shortened (or maintained short) if the battery voltage Vb is increased (or is high from the beginning). Accordingly, the probability that the electromagnetic valve 18 is closed at an early stage of the pressurizing stroke is increased. This is advantageous to guarantee that a sufficient amount of high pressure fuel be supplied to the fuel injection system, and the fuel pressure Pf is further effectively increased.

Figure 10:
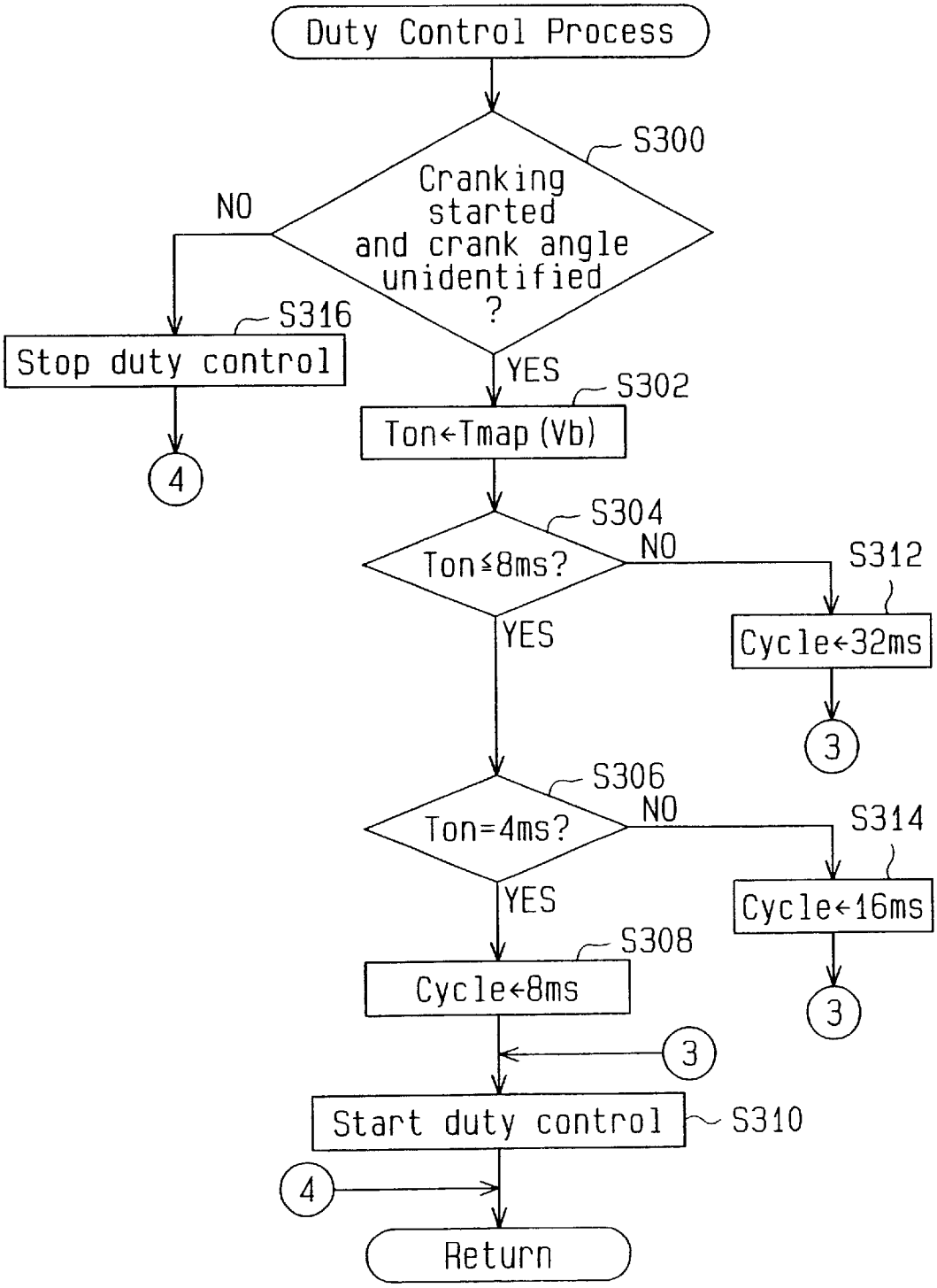
FIG. 10 is a flowchart showing a duty control process according to a third embodiment of the present invention, which process is executed when the engine is being cranked.

A third embodiment of the present invention will now be described with reference to FIGS. 10 and 12. The differences from the first embodiment of FIGS. 1 to 7 will mainly be discussed. This embodiment is different from the first embodiment in that, when the engine 4 is being cranked, a duty control process of FIG. 10 is performed instead of the duty control process of FIG. 5.

Figure 11:
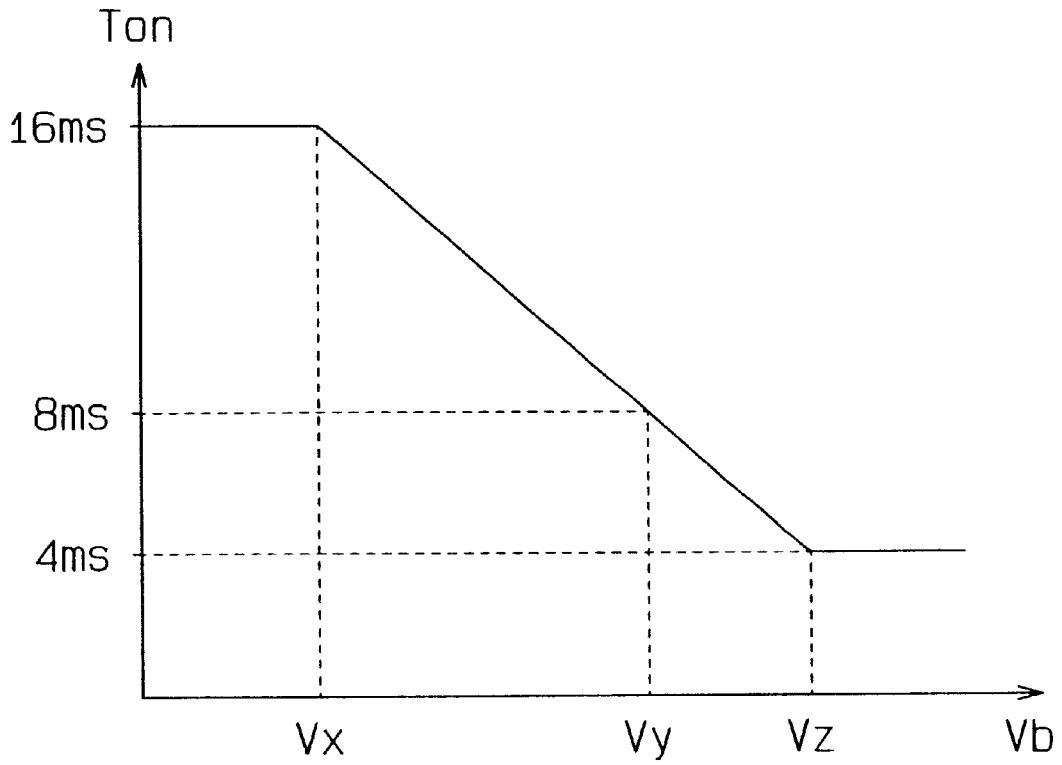
FIG. 11 is a graph showing a current supplying period map Tmap used in the duty control process of FIG. 10.

The duty control process of this embodiment will now be described with reference to a flowchart of FIG. 10. The process is repeatedly executed at a given interval, for example 8 ms, after the ECU 34 is turned on. When the process is started, the ECU 34 determines whether cranking of the engine 4 has been started and whether the crank angle is yet to be identified in step S300. If the crank angle is yet to be identified, the ECU 34 proceeds to step S302. In step S302, the ECU 34 uses a current supplying period map Tmap shown in FIG. 11 for computing a current supplying period Ton that corresponds to the battery voltage Vb.

The current supplying period Ton represents the duration of the current supplying period in one cycle of the duty control. In the current supplying period map Tmap of FIG. 11, the current supplying period Ton is set longer for lower values of the battery voltage Vb. However, if the battery voltage Vb is less than a predetermined low voltage Vx, the current supplying period Ton is maintained at an uppermost value, or 16 ms. Also, if the battery voltage Vb is equal to or higher than a predetermined high voltage Vz, the current supplying period Ton is maintained at a lowermost value, or 4 ms.

In step S304, the ECU 34 determines whether the computed current supplying period Ton is equal to or less than 8 ms. If the current supplying period Ton is longer than 8 ms, the ECU 34 proceeds to step S312, and sets the cycle of the duty control to 32 ms. In step S310, the ECU 34 controls the drive circuit 50 to perform a duty control of the cycle of 32 ms with the computed current supplying period Ton. Then, the ECU 34 temporarily suspends the process.

Therefore, in one cycle of the duty control to the electromagnetic valve 18, the excitation coil 18*a* is supplied with current for the current supplying period Ton. Thereafter, the current to the excitation coil 18*a* is stopped for a period computed by subtracting the current supplying period Ton from 32 ms.

Thereafter, if the battery voltage Vb is increased, the current supplying period Ton is gradually shortened every time the routine of FIG. 10 is executed. However, unless the current supplying period Ton is equal to or less than 8 ms, the cycle of the duty control is maintained at 32 ms. Accordingly, the duty ratio (the ratio of the current supplying period Ton to 32 ms) is gradually decreased.

When the current supplying period Ton is shortened to be equal to or less than 8 ms as the battery voltage Vb increases, the outcome of step S304 is positive, and the ECU S306 proceeds to step S306. The fact that the current supplying period Ton is equal to or less than 8 ms indicates that the duty ratio is maintained equal to or less than 50% even if the cycle of the duty ratio is changed to 16 ms. In step S306, the ECU 34 determines whether the computed current supplying period Ton is equal to 4 ms. If the current supplying period Ton is not equal to 4 ms, that is, if the current supplying period Ton is longer than 4 ms, which is the lowermost value, the ECU 34 proceeds to step S314, and sets the cycle of the duty control to 16 ms. In step S310, the ECU 34 controls the drive circuit 50 to perform a duty control of the cycle of 16 ms with the current supplying period Ton computed in step S302. Then, the ECU 34 temporarily suspends the process.

Thereafter, if the battery voltage Vb is increased, the current supplying period Ton is gradually shortened every time the routine of FIG. 10 is executed. However, unless the current supplying period Ton is equal to or less than 4 ms, the cycle of the duty control is maintained at 16 ms. Therefore, the duty ratio is gradually decreased.

When the current supplying period Ton is shortened to be equal to or less than 4 ms as the battery voltage Vb increases, the outcome of step S306 is positive, and the ECU S306 proceeds to step S308. In step S308, the ECU 34 sets the cycle of the duty control to be 8 ms. The fact that the current supplying period Ton is equal to or less than 4 ms indicates that the duty ratio becomes 50% when the cycle of the duty control is changed to 8 ms. In step S310, the ECU 34 controls the drive circuit 50 to perform a duty control of the cycle of 8 ms with the current supplying period Ton computed in step S302. Then, the ECU 34 temporarily suspends the process.

Afterwards, the duty control of the cycle of 8 ms is continued at the duty ratio of 50% until the crank angle is identified.

If the crank angle is identified (negative outcome in step S300), the ECU 34 proceeds to S316. In step S316, the ECU 34 stops the duty control and temporarily suspends the process. Afterwards, as long as the crank angle is identified, a normal current control according to the crank angle is executed (see FIG. 4).

Figure 12:
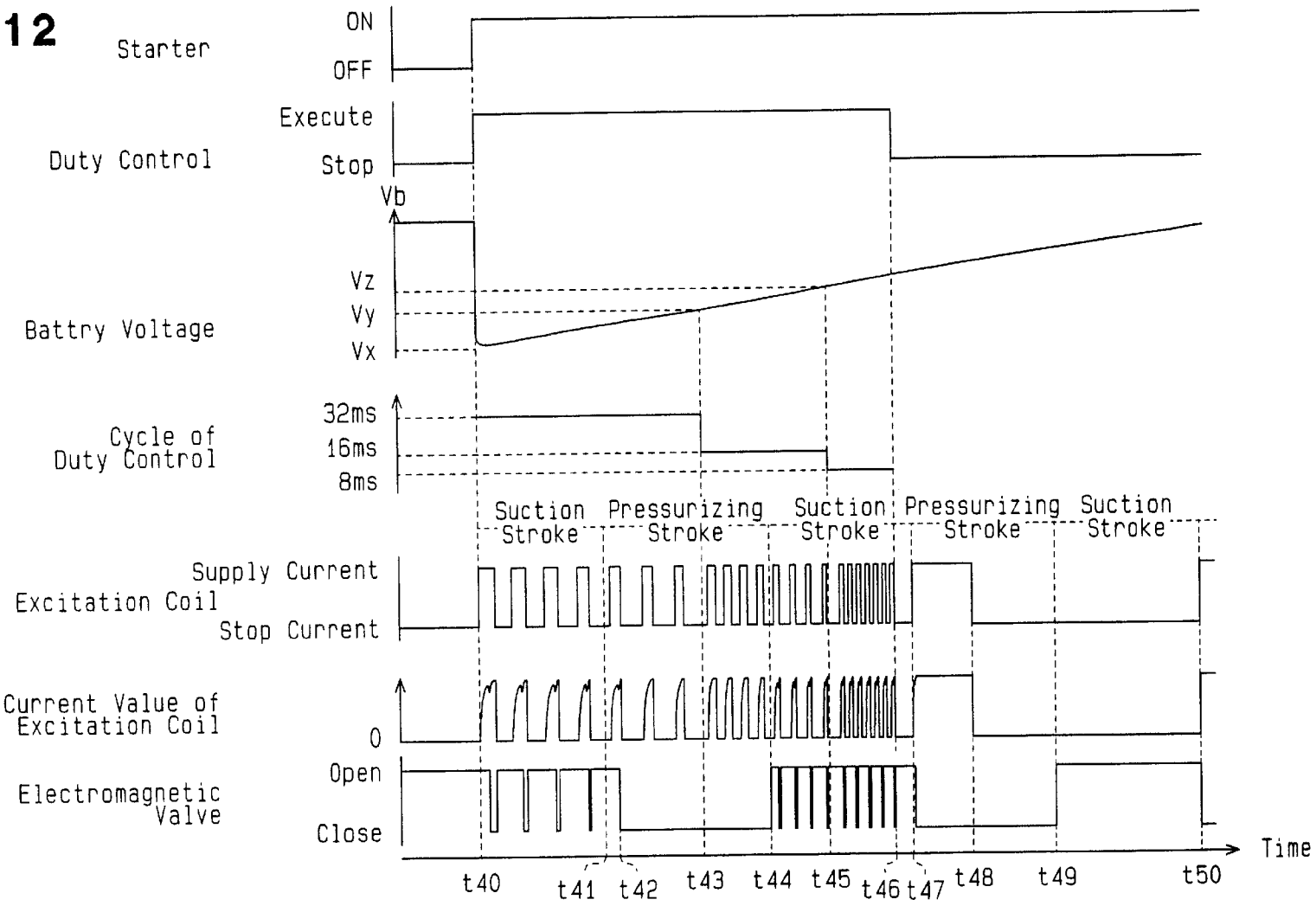
FIG. 12 is a timing chart showing an example of a control of the high pressure pump according to the third embodiment.
Figure 13:
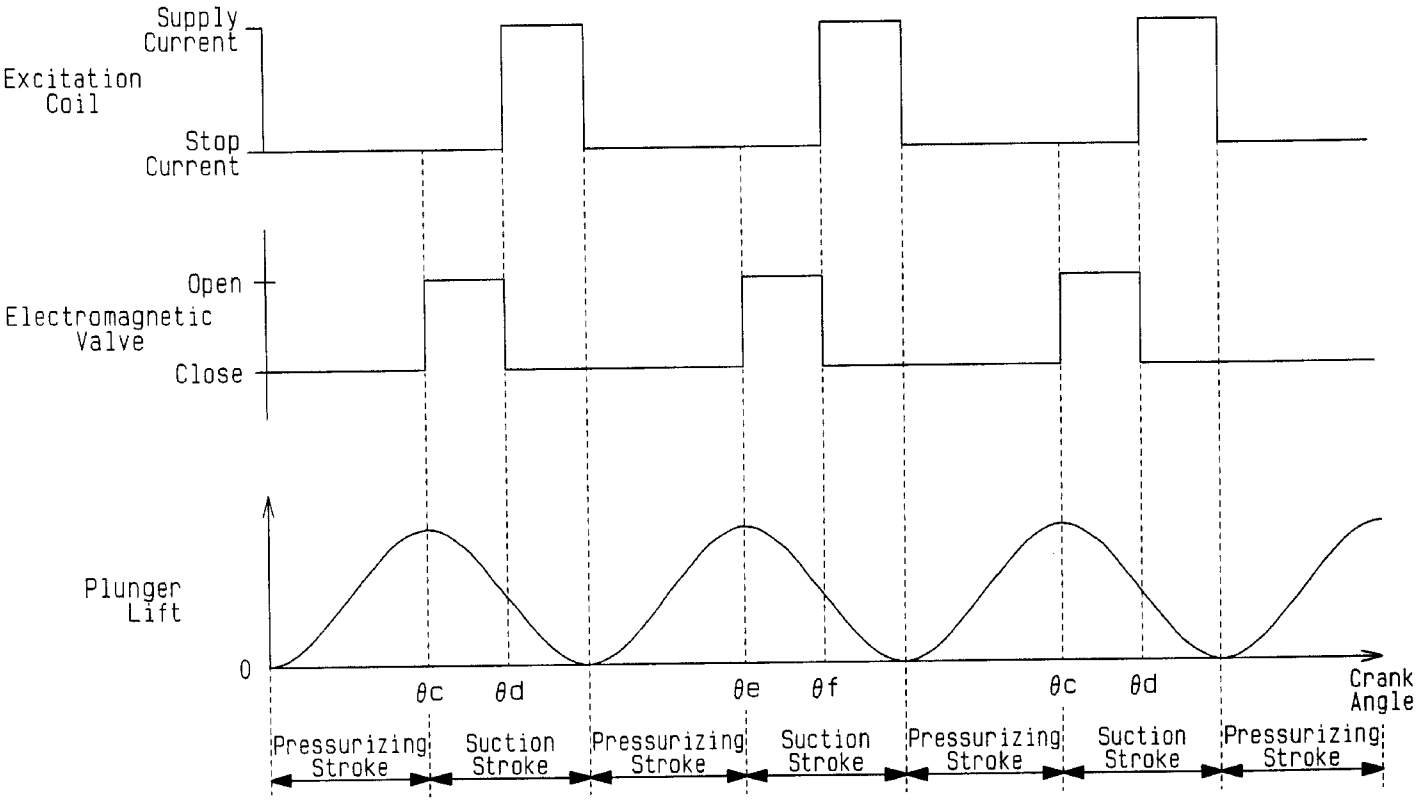
FIG. 13 is a crank angle chart showing an operation of a high pressure fuel pump according to another embodiment after the crank angle is identified.

One example of the process according to this embodiment is shown in the timing chart of FIG. 12. When the starter 46 is actuated at time t40, the duty control process of FIG. 10 is executed until time t46, at which the crank angle is identified. Accordingly, current is supplied and stopped to the excitation coil 18*a* at short cycles. At this time, the period from when the current supply to the excitation coil 18*a* is started to when the electromagnetic valve 18 is opened is gradually shortened as the battery voltage Vb is increased. Accordingly, the current supplying period Ton is gradually shortened based on the current supplying period map Tmap of FIG. 11.

During the above described duty control, the battery voltage Vb is lower than an intermediate voltage Vy in a period from time t40 to t43, and thus, the current supplying period Ton is longer than 8 ms. In the period from t40 to time t43, the cycle of the duty control is set to 32 ms. In a period from time t43 to t45, the battery voltage Vb is equal to or higher than the intermediate voltage Vy and lower than the high voltage Vz. Thus, the current supplying period Ton is equal to or less than 8 ms and longer than 4 ms. In the period from t43 to time t45, the cycle of the duty control is set to 16 ms. In a period from time t45 to time t46, the battery voltage Vb is equal to or higher than the high voltage Vz, and thus, the current supplying period Ton is set to 4 ms. In the period from t45 to time t46, the cycle of the duty control is set to 8 ms. That is, although the current supplying period Ton and the cycle of the duty control are shortened as the battery voltage Vb is increased, the cycle of the duty control is discretely shortened so that that the duty ratio does not exceed 50%, which is a predetermined acceptable value.

During the above described duty control, the electromagnetic valve 18 is repeatedly closed and opened in accordance with supplying and stopping of current in the period of each suction stroke of the high pressure pump 2 (the period from time t40 to time t41, and the period from t44 to t46). When the electromagnetic valve 18 is opened, low pressure fuel is drawn into the pressurizing chamber 14 from the low pressure fuel passage 20 through the fuel inlet 16.

In a pressurizing stroke from time t41 to time t44, the electromagnetic valve 18 is closed at t42. Afterwards, the electromagnetic valve 18 is kept closed until time t44, which is the end of the pressurizing stroke, regardless how many times the current to the excitation coil 18*a* is stopped. In the period from time t42 to time t44, in which the electromagnetic valve 18 is closed, high pressure fuel in the pressurizing chamber 14 pushes open the check valve 26 and is sent to the delivery pipe 30.

In a suction stroke from time t44 to time t47, the crank angle is identified at t46. Therefore, after time t46, the control is shifted from the duty control to the normal control for the electromagnetic control described referring to FIG. 4. That is, the normal process, in which the electromagnetic valve 18 is opened in a suction stroke and is closed in a pressurizing stroke, is repeated so that the fuel pressure Pf is increased to a target fuel pressure.

In the prior art, the cycle and the current supplying period in a duty control are not extended even if the battery voltage Vb is low. Therefore, in the initial pressurizing stroke (refer to the period from time t41 to t44 in FIG. 12), the pressure of the fuel in the pressurizing chamber 14 is not increased, and the fuel is not supplied to the delivery pipe 30. Therefore, compared to this embodiment, the pressure increase in the fuel injection system is delayed.

This embodiment substantially has the same advantages as the first and second embodiments. If the battery voltage Vb is high, the cycle of the duty control is shortened to a level at which the duty ratio does not exceed 50%. Therefore, the ratio of the current supplying period in the duty control is not unnecessarily increased, and the load on the electric circuit is effectively prevented from increasing.

The present invention may be modified as follows.

In the second embodiment of FIGS. 8 and 9, the cycle of the duty control is discretely changed according to the battery voltage Vb. However, the cycle of the duty control may be continuously changed. In the first embodiment of FIGS. 1 to 7 and in the third embodiment of FIGS. 10 to 12, the current supplying period in the duty control (duty ratio) may be discretely changed according to the battery voltage Vb.

In the illustrated embodiments, the high pressure fuel pump is controlled to adjust the supply amount of pressurized fuel in each pressurizing stroke after the crank angle is identified. That is, after the crank angle is identified, the electromagnetic valve 18 is opened in the entire suction stroke. In the pressurizing stroke, the electromagnetic valve 18 is closed in a crank angle range that corresponds to the amount of fuel to be sent to the delivery pipe 30 (see FIG. 4). However, the high pressure fuel pump may be controlled to adjust the supply amount of pressurized fuel in suction strokes after the crank angle is identified. For example, during a suction stroke after the crank angle is identified, current to electromagnetic valve 18 may be stopped to open the electromagnetic valve 18 in a crank angle range corresponding to the amount of fuel to be sent to the delivery pipe 30 (a range from θc to θd and a range from θe to θf), so that fuel is drawn into the pressurizing chamber 14 only in these crank angle ranges. The electromagnetic valve 18 is closed in the entire pressurizing stroke. In this case, the supply amount of pressurized fuel is decreased if the current supply starting crank angles θd, θf are advanced. The supply amount of pressurized fuel is increased if the current supply starting crank angles θd, θf are delayed.

Therefore, the present examples and embodiments are to be considered as illustrative and not restrictive and the invention is not to be limited to the details given herein, but may be modified within the scope and equivalence of the appended claims.

What is claimed is:

1. A high pressure fuel supplying apparatus, which pressurizes fuel supplied from a fuel supply source and sends the pressurized fuel to a fuel injection system of an internal combustion engine, the apparatus comprising:

a fuel pump having a pressurizing chamber, wherein the fuel pump repeats a pressurizing stroke and a suction stroke in accordance with rotation of the engine, wherein, during each suction stroke, the fuel pump draws fuel from the fuel supply source to the pressurizing chamber, and wherein, during each pressurizing stroke, the fuel pump pressurizes fuel in the pressurizing chamber and sends the pressurized fuel to the fuel injection system;

an electromagnetic valve that selectively connects and disconnects the pressurizing chamber with the fuel supply source, wherein the electromagnetic valve is actuated by electricity supplied from a power supply;

a voltage detecting device, which detects a voltage of the power supply; and a controller, which controls the electromagnetic valve, wherein, to adjust an amount of fuel to be supplied to the fuel injection system, the controller determines opening and closing timing of the electromagnetic valve based on a rotational phase of the engine, wherein, when the rotational phase of the engine is not identified, the controller executes a duty control to cyclically repeat supplying and stopping of current to the electromagnetic valve, and wherein the controller extends a current supplying period in each cycle of the duty control as the voltage detected by the voltage detecting device is lowered.

2. The apparatus according to claim 1, wherein the controller continuously changes the current supplying period according to the voltage detected by the voltage detecting device.

3. The apparatus according to claim 1, wherein the controller discretely changes the current supplying period according to the voltage detected by the voltage detecting device.

4. The apparatus according to claim 1, wherein the controller changes the duty ratio for changing the current supplying period.

5. The apparatus according to claim 1, wherein the controller changes the cycle of the duty control for changing the current supplying period.

6. The apparatus according to claim 1, wherein, when the rotational phase of the engine is not identified, the controller, in addition to extending the current supplying period, extends the cycle of the duty control as the voltage detected by the voltage detecting device is lowered, and wherein the controller sets the cycle of the duty control such that the duty ratio does not exceed a predetermined acceptable value.

7. The apparatus according to claim 1, wherein the electromagnetic valve includes a valve body located in the pressurizing chamber, wherein a valve seat is provided at a part of an inner wall of the pressurizing chamber that faces the valve body, wherein, when supply of current to the electromagnetic valve is started, the valve body is moved toward and contacts the valve seat, and wherein current to the electromagnetic valve is stopped, the valve body is moved toward the interior of the pressurizing chamber away from the valve seat.

8. The apparatus according to claim 1, wherein the electromagnetic valve has a valve body and an urging member, wherein the valve body is capable of moving between a closed position for disconnecting the pressurizing chamber from the fuel supply source and an open position for connecting the pressurizing chamber with the fuel supply source, wherein the urging member urges the valve body toward the open position, wherein, when current is supplied to the electromagnetic valve, the valve body is moved to the closed position against the force of the urging member, and wherein, when current is not supplied to the electromagnetic valve, the valve body is moved to the open position by the force of the urging member.

9. The apparatus according to claim 8, wherein, when the valve body is moved to the closed position during a pressurizing stroke of the fuel pump, the pressure in the pressurizing chamber acts on the valve body to retain the valve body at the closed position.

10. The apparatus according to claim 7, wherein the controller determines a stroke position of the fuel pump based on the rotational phase of the engine, wherein, when the fuel pump is at a suction stroke, the controller stops current to the electromagnetic valve, and wherein, when the fuel pump is at a pressurizing stroke, the controller starts supplying current to the electromagnetic valve at timing that corresponds to the amount of fuel to be supplied to the fuel injection system.

11. The apparatus according to claim 7, wherein the controller determines a stroke position of the fuel pump based on the rotational phase of the engine, wherein, when the fuel pump is at a suction stroke, the controller stops current to the electromagnetic valve for a period that corresponds to the amount of fuel to be supplied to the fuel injection system, and wherein, when the fuel pump is at a pressurizing stroke, the controller closes the electromagnetic valve.

12. A high pressure fuel supplying apparatus, which pressurizes fuel supplied from a fuel supply source and sends the pressurized fuel to a fuel injection system of an internal combustion engine, the apparatus comprising:

a fuel pump having a pressurizing chamber, wherein the fuel pump repeats a pressurizing stroke and a suction stroke in accordance with rotation of the engine, wherein, during each suction stroke, the fuel pump draws fuel from the fuel supply source to the pressurizing chamber, and wherein, during each pressurizing stroke, the fuel pump pressurizes fuel in the pressurizing chamber and sends the pressurized fuel to the fuel injection system;

an electromagnetic valve that selectively connects and disconnects the pressurizing chamber with the fuel supply source, wherein the electromagnetic valve is actuated by electricity supplied from a power supply, wherein the electromagnetic valve includes a valve body located in the pressurizing chamber, wherein a valve seat is provided at a part of an inner wall of the pressurizing chamber that faces the valve body, wherein the valve body is urged away from the valve seat by an urging member, wherein, when supply of current to the electromagnetic valve is started, the valve body is moved toward and contacts the valve seat against the force of the urging member, and wherein, when current to the electromagnetic valve is stopped, the valve body is moved toward the interior of the pressurizing chamber away from the valve seat by the force of the urging member;

a rotational phase detecting device, which detects a rotational phase of the engine;

a voltage detecting device, which detects a voltage of the power supply;

a controller, which controls the electromagnetic valve, wherein, to adjust an amount of fuel to be supplied to the fuel injection system, the controller determines opening and closing timing of the electromagnetic valve based on a rotational phase of the engine, wherein, when the rotational phase of the engine is not identified, the controller executes a duty control to cyclically repeat supplying and stopping of current to the electromagnetic valve, and wherein the controller extends a current supplying period in each cycle of the duty control as the voltage detected by the voltage detecting device is lowered.

13. The apparatus according to claim 12, wherein the controller changes the duty ratio for changing the current supplying period.

14. The apparatus according to claim 12, wherein the controller changes the cycle of the duty control for changing the current supplying period.

15. The apparatus according to claim 12, wherein, when the rotational phase of the engine is not identified, the controller, in addition to extending the current supplying period, extends the cycle of the duty control as the voltage detected by the voltage detecting device is lowered, and wherein the controller sets the cycle of the duty control such that the duty ratio does not exceed a predetermined acceptable value.

16. The apparatus according to claim 12, wherein, when the valve body contacts the valve seat during a pressurizing stroke of the fuel pump, the pressure in the pressurizing chamber acts on the valve body such that the valve body remains contacting the valve seat.

17. A method for controlling a high pressure fuel supplying apparatus for an internal combustion engine, wherein the apparatus includes a fuel pump having a pressurizing chamber and an electromagnetic valve, wherein the fuel pump repeats a pressurizing stroke and a suction stroke in accordance with rotation of the engine, wherein, during each suction stroke, the fuel pump draws fuel from a fuel supply source to the pressurizing chamber, and wherein, during each pressurizing stroke, the fuel pump pressurizes fuel in the pressurizing chamber and sends the pressurized fuel to a fuel injection system of the engine, wherein the electromagnetic valve is actuated by electricity supplied from a power supply to selectively connect and disconnect the pressurizing chamber with the fuel supply source, the method comprising:

determining opening and closing timing of the electromagnetic valve based on a rotational phase of the engine, thereby adjusting an amount of fuel to be supplied to the fuel injection system;

executing a duty control to cyclically repeat supplying and stopping of current to the electromagnetic valve when the rotational phase of the engine is not identified; and extending a current supplying period in each cycle of the duty control as the voltage of the power supply is lowered.

* * * * *